US009181947B2

(12) United States Patent
Lee et al.

(10) Patent No.: US 9,181,947 B2
(45) Date of Patent: Nov. 10, 2015

(54) COMPRESSOR

(75) Inventors: Kang-Wook Lee, Changwon-si (KR); Jin-Ung Shin, Changwon-si (KR); Geun-Hyung Lee, Busan (KR); Seoung-Min Kang, Gimhae-si (KR)

(73) Assignee: LG ELECTRONICS INC., Seoul (KR)

( * ) Notice: Subject to any disclaimer, the term of this patent is extended or adjusted under 35 U.S.C. 154(b) by 432 days.

(21) Appl. No.: 13/387,465

(22) PCT Filed: Dec. 2, 2009

(86) PCT No.: PCT/KR2009/007166

§ 371 (c)(1),
(2), (4) Date: Jan. 27, 2012

(87) PCT Pub. No.: WO2011/019114

PCT Pub. Date: Feb. 17, 2011

(65) Prior Publication Data

US 2012/0128516 A1 May 24, 2012

(30) Foreign Application Priority Data

Aug. 10, 2009 (KR) ..... 10-2009-0073279
Aug. 10, 2009 (KR) ..... 10-2009-0073280
Aug. 10, 2009 (KR) ..... 10-2009-0073287

(51) Int. Cl.
*F04C 18/356* (2006.01)
*F04C 18/32* (2006.01)
(Continued)

(52) U.S. Cl.
CPC ..... *F04C 18/3564* (2013.01); *F01C 21/02* (2013.01); *F04C 18/322* (2013.01);
(Continued)

(58) Field of Classification Search
CPC .... F16N 2013/20; F01C 21/04; F04C 23/008; F25B 31/023; F04B 39/121
USPC ..... 417/410.3; 418/83, 55.6, 248, 228, 229, 418/230, 243
See application file for complete search history.

(56) References Cited

U.S. PATENT DOCUMENTS 1,964,415 A * 6/1934 Van Deventer ..... 417/356
2,309,577 A * 1/1943 Davidson ..... 418/87
(Continued)

FOREIGN PATENT DOCUMENTS

CN 100386526 C 5/2008
JP 62-284985 12/1987
(Continued)

OTHER PUBLICATIONS
Chinese Office Action dated Jan. 6, 2014. (translation).
(Continued)

*Primary Examiner* — Charles Freay
*Assistant Examiner* — Lilya Pekarskaya
(74) *Attorney, Agent, or Firm* — Ked & Associates LLP

(57) ABSTRACT

A compressor is provided in which a rotary member suspended on a stationary member is rotated to compress a refrigerant. As the rotary member is suspended on a first stationary member and rotatably supported on a second stationary member spaced apart from the first stationary member, components can be easily centered and assembled with structural stability. In addition, oil stored in a hermetic container is supplied to a lubrication passage provided between the rotary member and the stationary member. This reduces friction loss between the components and achieves operational reliability. Moreover, the oil is easily introduced into a vane mounting hole in which a vane is linearly reciprocated. This reduces friction and abrasion of the vane and improves the operational reliability.

10 Claims, 14 Drawing Sheets

(51) Int. Cl.

| | |
|---|---|
| ***F01C 21/02*** | (2006.01) |
| ***F04C 23/00*** | (2006.01) |
| ***F04C 29/00*** | (2006.01) |
| ***F04C 29/02*** | (2006.01) |
| ***F04C 23/02*** | (2006.01) |

(52) U.S. Cl.

CPC ..... *F04C23/008* (2013.01); *F04C 23/02* (2013.01); *F04C 29/0071* (2013.01); *F04C 29/0085* (2013.01); *F04C 29/023* (2013.01); *F04C 2230/603* (2013.01); *F04C 2240/10* (2013.01); *F04C 2240/30* (2013.01); *F04C 2240/40* (2013.01); *F04C 2240/52* (2013.01); *F04C 2240/60* (2013.01); *F04C 2270/12* (2013.01)

(56) References Cited

U.S. PATENT DOCUMENTS

| | | | | | |
|---|---|---|---|---|---|
| 2,415,011 | A | * | 1/1947 | Hubacker | 417/256 |
| 2,420,124 | A | * | 5/1947 | Coulson | 417/356 |
| 2,440,593 | A | * | 4/1948 | Miller | 418/88 |
| 2,670,894 | A | | 3/1954 | Warrick et al. | |
| 3,664,461 | A | * | 5/1972 | Leffers et al. | 184/6.16 |
| 4,871,304 | A | * | 10/1989 | Iida et al. | 418/220 |
| 5,409,358 | A | * | 4/1995 | Song | 418/63 |
| 5,733,112 | A | * | 3/1998 | Kang | 418/174 |
| 7,217,110 | B2 | * | 5/2007 | Dreiman | 418/173 |
| 2006/0182646 | A1 | | 8/2006 | Sato | |
| 2011/0027117 | A1 | * | 2/2011 | Fujino et al. | 418/88 |

FOREIGN PATENT DOCUMENTS

| | | | |
|---|---|---|---|
| JP | 01-100291 | | 4/1989 |
| JP | 2006-226179 | A | 8/2006 |
| KR | 10-0835187 | B1 | 6/2008 |
| WO | WO 2006/046784 | A1 | 5/2006 |

OTHER PUBLICATIONS

Korean Office Action issued in Application No. 10-2009-0073279 dated May 1, 2015.

Korean Office Action issued in Application No. 10-2009-0073280 dated May 1, 2015.

International Search Report issued in PCT Application No. PCT/KR2009/007166 dated Feb. 19, 2010.

* cited by examiner

COMPRESSOR

CROSS-REFERENCE TO RELATED PATENT APPLICATIONS

This application is a U.S. National Stage Application under 35 U.S.C. §371 of PCT Application No. PCT/KR2009/007166, filed Dec. 2, 2009, which claims priority to Korean Patent Application No. 10-2009-0073279 filed in Korea on Aug. 10, 2009, Korean Patent Application No. 10-2009-0073280 filed in Korea on Aug. 10, 2009, and Korean Patent Application No. 10-2009-0073287 filed in Korea on Aug. 10, 2009.

TECHNICAL FIELD

The present invention relates to a compressor in which a rotary member suspended on a stationary member and supported on a shaft holder is rotated to compress the refrigerant, and more particularly, to a compressor which can achieve the structural stability, improve an assembly property, and enhance the lubrication performance to ensure the operation reliability.

BACKGROUND ART

In general, a compressor is a mechanical apparatus receiving power from a power generation apparatus such as an electric motor, a turbine or the like, and compressing the air, refrigerant or various working gases to raise a pressure. The compressor has been widely used for electric home appliances such as refrigerators and air conditioners, and application thereof has been expanded to the whole industry.

The compressors are roughly classified into a reciprocating compressor in which a compression space into/from which a working gas is sucked and discharged is defined between a piston and a cylinder and the piston is linearly reciprocated in the cylinder to compress the refrigerant, a rotary compressor in which a working gas is compressed in a compression space defined between an eccentrically-rotated roller and a cylinder, and a scroll compressor in which a compression space into/from which a working gas is sucked and discharged is defined between an orbiting scroll and a fixed scroll and the orbiting scroll is rotated along the fixed scroll to compress the refrigerant.

While the reciprocating compressor has excellent mechanical efficiency, this reciprocating motion causes serious vibration and noise problems. In order to solve the foregoing problems, the rotary compressor has been developed due to its compact structure and excellent vibration characteristic.

The rotary compressor is configured such that a motor unit and a compression mechanism unit are mounted on a driving shaft in a hermetic container. A roller located near an eccentric portion of the driving shaft is located in a cylinder defining a cylindrical compression space, one or more vanes extend between the roller and the compression space to partition the compression space into a suction region and a compression region, and the roller is eccentrically located in the compression space. In general, the vane is supported on a groove portion of the cylinder by a spring to pressurize a surface of the roller, and the compression space is partitioned into the suction region and the compression region by the vane as mentioned above. With the rotation of the driving shaft, the suction region is gradually increased such that the refrigerant or working fluid is sucked into the suction region, and at the same time, the compression region is gradually decreased such that the refrigerant or working fluid therein is compressed.

In the conventional rotary compressor, since the motor unit and the compression mechanism unit are stacked on the upper and lower sides, the overall height of the compressor is inevitably increased. Moreover, in the conventional rotary compressor, since the motor unit and the compression mechanism unit have different weights, a difference in the force of inertia and a problem of unbalance are generated on the upper and lower sides of the driving shaft. Therefore, in order to compensate for the unbalance between the motor unit and the compression mechanism unit, a weight member may be superimposed on a relatively small weight side. However, this applies an additional load to a rotary body, thereby reducing the driving efficiency and the compression efficiency. Further, in the conventional rotary compressor, the eccentric portion is formed on the driving shaft in the compression mechanism unit. The eccentric portion is rotated with the rotation of the driving shaft to drive the roller located outside the eccentric portion. As a result, the vibration is inevitably generated in the compression mechanism unit due to the eccentric rotation of the driving shaft and the eccentric portion. Furthermore, in the conventional rotary compressor, when the eccentric portion of the driving shaft is rotated, it is continuously in sliding-contact with an inner surface of the cylinder with the roller fixed thereto and a tip section of the vane with the roller fixed thereto. A high relative velocity is present between the components brought into sliding-contact, which generates a friction loss and leads to reduction of the efficiency of the compressor. Additionally, a refrigerant leakage probability is present on a sliding-contact surface between the vane and the roller, which degrades the mechanical reliability.

While the conventional rotary compressor is configured such that the driving shaft is rotated in the stationary cylinder, a rotary compressor disclosed in Japanese Patent Publication Nos. 62-284985 and 64-100291 includes: a stationary shaft having a shaft and a piston portion which are integrally formed, the shaft having an inlet port in the shaft line direction, the piston portion being eccentric at a larger diameter than that of the shaft and having a port in the radial direction to communicate with the inlet port of the shaft; a protruding vane; a rotor which is rotatable with the vane accommodated therein; an upper bearing having an outlet port; a lower bearing; a permanent magnet formed in a hollow cylindrical shape with a height greater than a difference between an outer diameter and an inner diameter and fixed to the lower bearing; and a coil which is not rotated on the outer circumference of the permanent magnet. The upper bearing, the rotor and the lower bearing are rotatably connected in order, and the vane encloses the space between the rotor and the upper bearing and the lower bearing and the piston portion. There is a change in volume.

In the rotary compressor disclosed in the above Japanese Patent Publications, the hollow cylindrical permanent magnet is located inside the stator, and the rotor including the vane and the compression mechanism unit are located inside the permanent magnet. Accordingly, this rotary compressor is considered to solve the problem of the conventional rotary compressor generated because the motor unit and the compression mechanism unit are installed in the height direction.

However, in the rotary compressor disclosed in the above Japanese Patent Publications, the vane is elastically supported on the rotating rotor and is in sliding-contact with an outer surface of the stationary eccentric portion (piston portion). Like the conventional rotary compressor, a large relative velocity difference is present between the vane and the eccentric portion (piston portion), which generates a friction loss, and a refrigerant leakage probability is still present on sliding-contact surfaces of the vane and the eccentric portion. Moreover, the rotary compressor disclosed in the above Japanese Patent Publications does not suggest any realizable structure for suction and discharge passages of a working fluid, lubrication oil feeding in the compression mechanism unit, or mounting of a bearing member, and thus does not reach the stage of practical application.

Meanwhile, U.S. Pat. No. 7,217,110 discloses a rotary compressor in which a stationary shaft and an eccentric portion are integrally formed and a compression space is defined between an outer surface of a roller rotatably located on the eccentric portion and an inner surface of a rotating rotor. Here, a rotation force of the rotor is transferred to the roller through a vane fixed to upper and lower plates of the rotor and integrally rotated with the rotor, and a working fluid and lubrication oil are introduced into the compression space through a longitudinal passage formed in the center of the stationary shaft using a difference between an inner pressure of a hermetic container and an inner pressure of the compression space.

Also in the rotary compressor disclosed in the above U.S. Patent Publication, a compression mechanism unit is formed inside the rotor. Accordingly, this rotary compressor is considered to solve the problem of the conventional rotary compressor generated because the motor unit and the compression mechanism unit are installed in the height direction. Further, unlike the Japanese patent publications, the rotor, the vane and the roller are integrally rotated, and thus do not have a relative velocity difference, thus preventing a friction loss.

However, in the rotary compressor disclosed in the above U.S. Patent Publication, one end portion of the stationary shaft is fixed to the hermetic container, but the other end thereof is spaced apart from the hermetic container and suspended on the hermetic container. It is thus difficult to center the stationary shaft. There are other problems such as weakness to the horizontal direction vibration caused by the eccentric rotation which is an inevitable characteristic of the rotary compressor, difficulty in manufacturing, or degradation of assembly productivity. Additionally, since the vane inwardly protrudes from the rotor and a vane groove is formed in the roller to guide a traveling track of the vane, the volume of the roller is inevitably increased to form the vane groove. The roller of a relatively large volume excites the horizontal direction vibration by the eccentric rotation. A structure not using the lubrication oil has also been disclosed. For this purpose, components should be formed of very expensive materials. With respect to a structure using the lubrication oil, the lubrication oil is lifted into the compression space using a difference between an inner pressure of the hermetic container and an inner pressure of the compression space and circulated with a working fluid. In this situation, a lot of lubrication oil may be inevitably incorporated in the working fluid and discharged from the compressor with the working fluid, which degrades the lubrication performance.

DISCLOSURE

Technical Problem

The present invention has been made in an effort to solve the above-described problems of the prior art, and an object of the present invention is to provide a compressor in which components can be easily centered and assembled in a hermetic container, thus improving the structural safety.

Another object of the present invention is to provide a compressor which can reduce the horizontal direction vibration caused by the eccentric rotation and simplify the actual production assembly.

A further object of the present invention is to provide a compressor in which the oil stored in a hermetic container can be supplied to a lubrication passage between a stationary member and a rotary member.

A still further object of the present invention is to provide a compressor in which the oil stored in a hermetic container can be easily introduced into a vane mounting hole with a vane mounted therein, thus easily lubricating the vane.

Technical Solution

According to an aspect of the present invention for achieving the above objects, there is provided a compressor, including: a hermetic container storing the oil; a stator fixed in the hermetic container; a first stationary member including a stationary shaft having a top end immovably installed in the hermetic container and being elongated into the hermetic container, and an eccentric portion eccentrically formed on the stationary shaft; a second stationary member spaced apart from a bottom end of the stationary shaft and immovably installed at a low portion of the hermetic container; a rotary member located between the stator and the first stationary member, rotated around the first stationary member by a rotating electromagnetic field from the stator, compressing the refrigerant sucked into a compression space defined therein, and rotatably supported by applying a load to the second stationary member; and a lubrication passage guiding the oil stored in the hermetic container to portions of the rotary member and the stationary member brought into bearing-contact using a rotation force of the rotary member.

In addition, the rotary member includes a rotor installed between the stator and the stationary member to rotate around the stationary member by a mutual electromagnetic force between the rotor and the stator, a cylinder stacked on the rotor, rotated with the rotor, and having a compression space therein, a vane elastically supported on the cylinder to partition the compression space between the eccentric portion and the cylinder into a suction pocket into which the refrigerant is sucked and a compression pocket in/from which the refrigerant is compressed and discharged, rotated with the cylinder, and brought into sliding-contact with an outer surface of the eccentric portion, a vane mounting hole formed in an inner circumferential surface of the cylinder in the shape of a slot, a vane spring stopper blocking the vane mounting hole such that a vane spring elastically supporting the vane is installed thereon, and upper and lower bearing covers forming upper and lower portions of the compression space and rotating around the stationary member with the rotary member.

Moreover, the rotary member includes a cylinder-type rotor rotatably supported on the stationary member to rotate around the stationary shaft by a rotating electromagnetic field from the stator, a roller applied with a rotation force of the cylinder-type rotor, rotated around the eccentric portion with the cylinder-type rotor, and defining a compression space between the roller and the cylinder-type rotor, a vane transferring the rotation force from the cylinder-type rotor to the roller and partitioning the compression space into a suction pocket into which the refrigerant is sucked and a compression pocket in/from which the refrigerant is compressed and discharged, a vane mounting hole integrally formed with the roller to protrude from an outer circumferential surface of the roller toward the cylinder-type rotor so as to accommodate the vane, and upper and lower bearing covers forming upper and lower portions of the compression space and rotating around the stationary member with the rotary member.

Further, the lower bearing cover includes a lower shaft portion enclosing the stationary shaft and a lower cover portion coupled to the cylinder to form the lower portion of the compression space, the bottommost end of the lower shaft portion is immersed in the oil stored in the hermetic container, and the lubrication passage includes a groove formed in an inner circumferential surface of the lower shaft portion which is brought into bearing-contact with an outer circumferential surface of the stationary shaft.

Furthermore, the lubrication passage includes a first oil supply passage formed in a lower portion of the stationary shaft in the axial direction, and a second oil supply passage formed in the eccentric portion to communicate with the first oil supply passage and a top surface of the eccentric portion.

Still furthermore, the compressor further includes a refrigerant suction passage penetrated through the stationary shaft and the eccentric portion and connected to the suction pocket of the compression space, wherein the second oil supply passage makes a detour around the refrigerant suction passage and extends to an upper portion of the eccentric portion.

Still furthermore, the lubrication passage includes upper and lower groove portions formed in top and bottom surfaces of the eccentric portion, respectively, and the upper and lower groove portions function as oil storage grooves for lubricating a thrust surface between the rotary member and the eccentric portion.

Still furthermore, the lubrication passage further includes a first oil storage groove provided in contact portions of the eccentric portion and a lower portion of the stationary shaft, and the lower bearing cover to communicate with the first oil supply passage, and a second oil storage groove provided in contact portions of the eccentric portion and an upper portion of the stationary shaft, and the upper bearing cover to communicate with the second oil supply passage.

Still furthermore, the upper bearing cover includes an upper shaft portion enclosing a part of a top end of the stationary shaft, and the lubrication passage further includes a groove provided in an inner circumferential surface of the shaft portion of the upper bearing cover to communicate with the second oil storage groove.

Still furthermore, the compressor further includes an oil supply member mounted at a lower portion of the rotary member and pumping the oil to the lubrication passage when the rotary member is rotated.

Still furthermore, the lower bearing cover includes a lower shaft portion enclosing the stationary shaft, and the oil supply member includes a hollow shaft portion press-fit into the lower shaft portion, and a propeller fixed to the inside of the hollow shaft portion to lift the oil in a spiral form with the rotation of the lower shaft portion.

Still furthermore, the compressor includes an oil supply hole enabling a part of the vane mounting hole to communicate with the inner space of the hermetic container such that the oil in the inner space is supplied to the vane mounting hole.

Still furthermore, the compressor includes an oil supply hole enabling a part of the vane mounting hole to communicate with the inner space of the hermetic container such that the oil in the inner space is supplied to the vane mounting hole, wherein the oil supply hole is formed in the vane spring stopper in a lower position than the level of the oil stored in the hermetic container to communicate with the vane mounting hole such that the oil is supplied to the vane mounting hole.

Still furthermore, the vane mounting hole is extended to a vane escape protrusion portion protruding from an outer circumferential surface of the cylinder, and an open space of the vane escape protrusion portion which is not closed by one or more of the upper and lower bearing covers functions as an oil supply hole for the vane mounting hole.

Still furthermore, the compressor includes an oil supply hole enabling a part of the vane mounting hole to communicate with the inner space of the hermetic container such that the oil in the inner space is supplied to the vane mounting hole, wherein an open space of the vane mounting hole which is not closed by one or more of the upper and lower bearing covers functions as an oil supply hole for the vane mounting hole.

Advantageous Effects

In the compressor according to the present invention, the rotary member is suspended on the stationary member, the stationary member is fixed to the upper shaft holder, the rotary member is rotatably supported on the lower shaft holder, and the upper and lower shaft holders are fixed to the hermetic container. As such, the components can be easily centered and assembled in the hermetic container, which leads to high structural safety and easy assembly.

Additionally, in the compressor according to the present invention, although the eccentric portion is eccentric from the center of the stationary shaft, it protrudes in the entire radial direction of the stationary shaft and maintains a still state. When the cylinder and the rotor are rotated around the stationary shaft, the vane is rotated around the eccentric portion. As the cylinder and the rotor, and the vane are rotated around the respective shafts, the eccentric rotation does not occur. As a result, it is possible to reduce the horizontal direction vibration caused by the eccentric rotation and omit the balance weight for reducing the vibration caused by the eccentric rotation. This improves efficiency and simplifies the actual production assembly.

Moreover, in the compressor according to the present invention, the oil stored in the hermetic container is supplied through the communicating passage to lubricate the contact surface between the lower bearing cover of the rotary member and the stationary member. Next, when the oil is pumped by the oil supply member, it is supplied through the communicating passage to lubricate the contact surface between the upper bearing cover of the rotary member and the stationary member. Therefore, it is possible to supply the oil to the components located higher than the oil level by over a set height using the oil supply member and reduce a friction loss between the components lubricated by the oil. This improves the compression efficiency and the operation reliability.

Further, in the compressor according to the present invention, although the vane is elastically supported by the vane spring or installed between the bushes in contact, since the oil supply hole is provided to enable the vane mounting hole with the vane mounted therein to communicate with the inner space of the hermetic container storing the oil, if the oil level is maintained higher than the oil supply hole, the oil can be easily introduced into the vane mounting hole. This improves the lubrication performance of the vane and reduces the friction and abrasion of the vane and the components brought into contact therewith. Furthermore, the vane is moved smoothly, which improves the operation reliability.

BEST MODE FOR CARRYING OUT INVENTION

Figure 1:
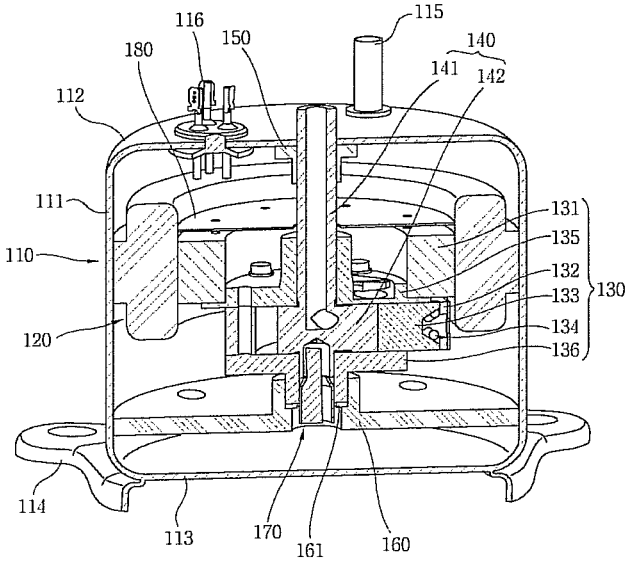
FIG. 1 is a side-sectional view of a first embodiment of a compressor according to the present invention.
Figure 2:
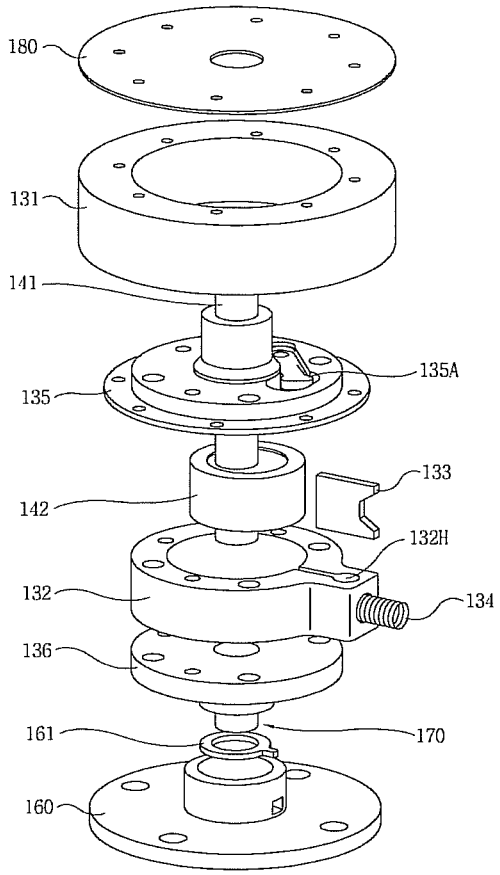
FIG. 2 is an exploded perspective view of the first embodiment of the compressor according to the present invention.
Figure 3:
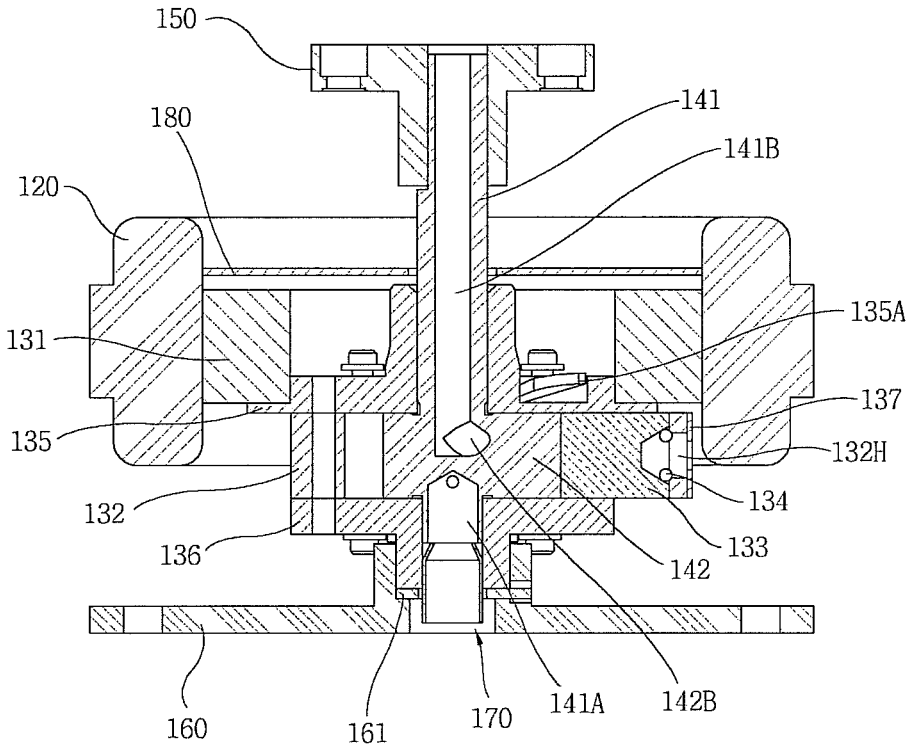
FIG. 3 is a side-sectional view of the first embodiment of the compressor according to the present invention.

FIGS. 1 to 3 are views of a first embodiment of a compressor according to the present invention.

As illustrated in FIGS. 1 to 3, the first embodiment of the compressor according to the present invention includes a hermetic container 110, a stator 120 fixed in the hermetic container 110, a rotary member 130 installed inside the stator 120 to be rotated by a rotating electromagnetic field from the stator 120 and compressing the refrigerant, a stationary member 140, the rotary member 130 being suspended on its outer circumferential surface, top and bottom ends of a stationary shaft 141 being immovably fixed to the hermetic container 110, an upper shaft holder 150 fixing the top end of the stationary shaft 141 to the inside of the hermetic container 110, and a lower shaft holder 160 spaced apart from the bottom end of the stationary shaft 141 and fixed to the inside of the hermetic container 110 such that the rotary member 130 is rotatably supported on its top surface. Here, a motor mechanism unit supplying power through an electrical action includes the stator 120 and a rotor 131 of the rotary member 130, and a compression mechanism unit compressing the refrigerant through a mechanical action includes the rotary member 130 and the stationary member 140. Therefore, the motor mechanism unit and the compression mechanism unit are partially stacked in the up-down direction and installed in the radial direction, which reduces the overall height of the compressor.

The hermetic container 110 includes a cylindrical body portion 111, upper and lower shells 112 and 113 coupled to upper and lower portions of the body portion 111, and a mounting portion 114 provided on a bottom surface of the lower shell 113 in the radial direction to fixedly fasten the hermetic container 110 to another product. The oil lubricating the rotary member 130 and the stationary member 140 can be stored in the hermetic container 110 at a proper height. The stationary shaft 141 is provided in the center of the upper shell 112 to be exposed therefrom, which is an example of a suction pipe (not shown) through which the refrigerant is sucked, and a discharge pipe 115 through which the refrigerant is discharged is provided in a given position of the upper shell 112. The compressor is determined as a high-pressure type or a low-pressure type according to whether the hermetic container 110 is filled with the compression refrigerant or pre-compression refrigerant. As such, the suction pipe and the discharge pipe may be reversed. In the embodiment of the present invention, the compressor is a high-pressure type and the stationary shaft 141 which is the suction pipe is provided to protrude to the outside of the hermetic container 110. However, there is no need that the stationary shaft 141 should excessively protrude to the outside of the hermetic container 110. Preferably, an appropriate fixing structure is installed on the outside of the hermetic container 110 and connected to an external refrigerant pipe. Additionally, a terminal 116 supplying power to the stator 120 is provided on the upper shell 112.

The stator 120 includes a core and a coil intensively wound on the core and is fixed to the inside of the body portion 111 of the hermetic container 110 by shrinkage fitting. A core employed in a general BLDC motor has 9 slots along the circumference. In the preferred embodiment of the present invention, the diameter of the stator 120 is relatively increased such that the core of the BLDC motor has 12 slots along the circumference. The more the slots of the core, the larger the winding number of the coil. Even if the height of the core is reduced, it is possible to produce an electromagnetic force of a general stator.

The rotary member 130 includes a rotor 131, a cylinder 132, a vane 133, a vane spring 134, an upper bearing cover 135 and a lower bearing cover 136. The rotor 131 is provided with a plurality of permanent magnets to be rotated by the rotating electromagnetic field from the stator 120 and installed inside the stator 120 to maintain a gap therefrom. The cylinder 132 is formed in a cylindrical shape with a compression space therein. A vane mounting hole 132H is formed in an inner circumferential surface of the cylinder 132 to be elongated in the radial direction such that the vane 133 and the vane spring 134 are mounted therein. The rotor 131 and the cylinder 132 are stacked in the up-down direction with the upper bearing cover 135 therebetween to be integrally rotated. The vane 133 has one end supported on an outer circumferential surface of an eccentric portion 142 described below and the other end elastically supported in the vane mounting hole 132H of the cylinder 132 by the vane spring 134. The vane 133 partitions a compression space between the cylinder 132 and the eccentric portion 142 into a suction pocket S (see FIG. 4) into which the refrigerant is sucked and a compression pocket D (see FIG. 4) in/from which the refrigerant is compressed and discharged. Preferably, a lubrication structure is applied such that the vane 133 is smoothly moved between the eccentric portion 142 and the vane mounting hole 132H of the cylinder 132.

The upper bearing cover 135 is in journal-bearing or thrust-bearing contact with the stationary member 140 and coupled to stack the rotor 131 and the cylinder 132 in the up-down direction. Here, an outer circumferential portion of a top surface of the upper bearing cover 135 is provided with a stepped portion such that the rotor 132 is fastened thereto. The rotor 131 is put on the stepped portion of the outer circumference of the top surface of the upper bearing cover 135 and bolt-fastened thereto, and the cylinder 132 is bolt-fastened to the center of a bottom surface of the upper bearing cover 135. Additionally, an outlet port (not shown) through which the refrigerant compressed in the compression space can be discharged and a discharge valve 135A installed thereon are provided at the upper bearing cover 135. Preferably, the outlet port of the upper bearing cover 135 is located adjacent to the vane 133 to reduce the dead volume. The upper bearing cover 135 is coupled to a bottom surface of the rotor 131 and a top surface of the cylinder 132, and the lower bearing cover 136 is coupled to a bottom surface of the cylinder 132. They are fastened respectively by a fastening member such as a long bolt, etc.

The stationary member 140 includes the stationary shaft 141 formed in a cylindrical shape, and the eccentric portion 142 protruding from the stationary shaft 141 in the entire radial direction of the stationary shaft 141 to have a cylindrical shape of a greater diameter than that of the cylinder of the stationary shaft 141 and eccentrically formed on the stationary shaft 141. A first oil supply passage 141A through which the oil stored in the hermetic container 110 can be supplied is formed at a lower portion of the stationary shaft 141, and a vertical suction passage 141B through which the low-pressure refrigerant can be sucked is formed at an upper portion of the stationary shaft 141. The oil supply passage 141A and the vertical suction passage 141B are isolated from each other, which prevents the oil from being discharged with the refrigerant. The eccentric portion 142 is expanded in the entire radial direction of the stationary shaft 141. A horizontal suction passage 142B is provided in the radial direction of the eccentric portion 142 and extended to an outer circumferential surface thereof to communicate with the vertical suction passage 141B of the stationary shaft 141. The vane 133 can pass through the horizontal suction passage 142B. Since top and bottom surfaces of the eccentric portion 142 are brought into contact with the upper and lower bearing covers 135 and 136 and operated as thrust surfaces, it is preferable to form a lubrication oil supply passage on the top and bottom surfaces of the eccentric portion 142, and since an outer circumferential surface of the eccentric portion 142 is brought into contact with the vane 133, it is preferable to form a lubrication oil supply passage to lubricate between the vane 133 and the eccentric portion 142.

The upper and lower shaft holders 150 and 160 immovably fix the stationary shaft 141 to the hermetic container 110 and rotatably support the rotary member 130. The upper shaft holder 150 is fixed to the upper shell 112 of the hermetic container 110 by welding or the like after an upper portion of the stationary shaft 141 is fitted thereinto. The upper shaft holder 150 is smaller than the lower shaft holder 160 in the radial direction. The reason for this is to prevent the interference with the suction pipe or the terminal 116 provided on the upper shell 112. In the meantime, the lower shaft holder 160 is spaced apart from a lower portion of the stationary shaft 141 and fixed to a side surface of the body portion 111 of the hermetic container 110 by shrinkage fitting or 3-point welding after a shaft portion of the lower bearing cover 136 enclosing the lower portion of the stationary shaft 141 is rotatably supported on a thrust bearing 161. The upper and lower shaft holders 150 and 160 are manufactured by press working, but the vane 133, the upper and lower bearing covers 135 and 136, and the stationary shaft 141 and the eccentric portion 142 are manufactured by casting using cast iron, grinding and additional machining.

Meanwhile, a structure in which the rotary member 130 is rotatably coupled to the stationary member 140 will be described. The upper and lower bearing covers 135 and 136 are rotatably installed on the stationary member 140 and the lower shaft holder 160. In more detail, the upper bearing cover 135 includes an upper shaft portion 135*a* enclosing an upper portion of the stationary shaft 141, and an upper cover portion 135*b* and 135*c* brought into contact with a top surface of the eccentric portion 142. The upper cover portion 135*b* and 135*c* includes a cylinder coupling portion 135*b* having a relatively large thickness to resist the pressure of the compression space, the cylinder 132 being bolt-fastened to a bottom surface thereof, and a rotor coupling portion 135*c* having a relatively small thickness and formed on an outer circumferential surface of the cylinder coupling portion 135*b* with a stepped portion, the rotor 131 being seated on and bolt-fastened to a top surface thereof. Here, a journal bearing journal-supporting the outer circumferential surface of the upper portion of the stationary shaft 141 is provided on an inner circumferential surface of the upper shaft portion 135*a*, and a thrust bearing thrust-supporting the top surface of the eccentric portion 142 is provided on a bottom surface of the upper cover portion 135*b* and 135*c* or the cylinder coupling portion 135*b*. In addition, the lower bearing cover 136 includes a lower shaft portion 136*a* enclosing a lower portion of the stationary shaft 141, and a lower cover portion 136*b* brought into contact with a bottom surface of the eccentric portion 142. Here, a journal bearing journal-supporting the outer circumferential surface of the lower portion of the stationary shaft 141 is provided on an inner circumferential surface of the lower shaft portion 136*a*, and a thrust bearing thrust-supporting the bottom surface of the eccentric portion 142 is provided on a top surface of the lower cover portion 136*b*. Moreover, the lower shaft holder 160 includes a cylindrical bearing portion 160*a* having a stepped portion and enclosing the lower shaft portion 136*a*, and a mounting portion 160*b* expanded in the radial direction of the bearing portion 160*a* and fixedly welded to the inside of the hermetic container 110. Here, a journal bearing journal-supporting the outer circumferential surface of the lower shaft portion 136*a* is provided on an inner circumferential surface of the bearing portion 160*a*, and a thrust bearing thrust-supporting a bottom end of the lower shaft portion 136*a* is provided on the stepped bottom surface of the bearing portion 160*a*, or a thrust bearing 161 formed in a plate shape may be inserted therebetween.

Accordingly, when the upper and lower bearing covers 135 and 136 are coupled to the rotor 131, the cylinder 132 and the stationary member 140 in the axial direction, the bottom surface of the cylinder coupling portion 135*b* of the upper bearing cover 135 is bolt-fastened in contact with the top surface of the cylinder 132, the top surface of the rotor coupling portion 135*c* of the upper bearing cover 135 is bolt-fastened in contact with the bottom surface of the rotor 131, and the lower cover portion 136*b* of the lower bearing cover 136 is bolt-fastened in contact with the bottom surface of the cylinder 132. Here, the upper shaft portion 135*a* is journal-bearing supported on the upper portion of the stationary shaft 141 and the upper cover portion 135*b* and 135*c* is thrust-supported on the top surface of the eccentric portion 142 such that the upper bearing cover 135 is rotatably installed with respect to the stationary shaft 141, and the lower shaft portion 136*a* is journal-bearing supported on the lower portion of the stationary shaft 141 and the lower cover portion 136*b* is thrust-supported on the bottom surface of the eccentric portion 142 such that the lower bearing cover 136 is rotatably installed with respect to the lower shaft holder 160. Additionally, the lower shaft portion 136*a* of the lower bearing cover 136 is fitted into the bearing portion 160*a* of the lower shaft holder 160. As the journal surfaces or thrust surfaces brought into contact with each other are bearing-supported, the lower bearing cover 136 is rotatably supported with respect to the lower shaft holder 160.

Figure 4:
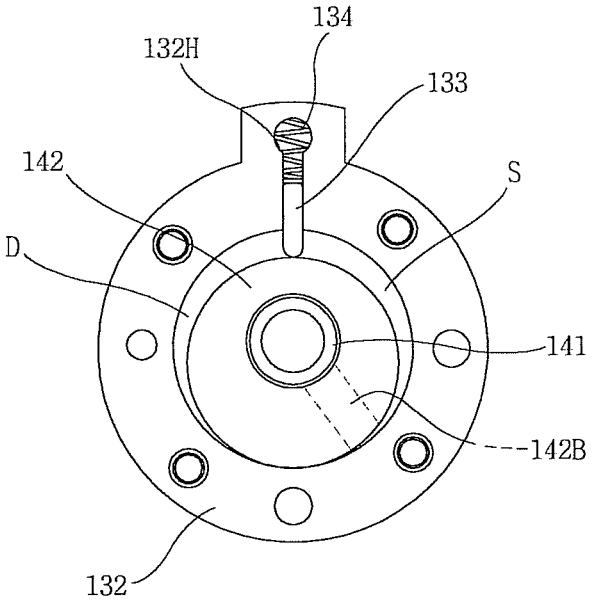
FIG. 4 is a plan view of a vane mounting structure in the first embodiment of the compressor according to the present invention.

FIG. 4 is a plan view of a vane mounting structure in the first embodiment of the compressor according to the present invention.

The mounting structure of the vane 133 will be described with reference to FIG. 4. A vane escape protrusion portion 132A is provided at one side of an outer circumferential surface of the cylinder 132 to protrude therefrom, a vane mounting hole 132H is formed in an inner/outer circumferential surface of the cylinder 132 to be elongated in the radial direction and penetrated in the axial direction, and a vane spring stopper 137 (see FIG. 3) is provided at an outer circumferential surface of the cylinder 132 to block the vane mounting hole 132H and support the vane spring 134. Therefore, one end of the vane 133 is elastically supported in the vane mounting hole 132H by the vane spring 134 and the other end thereof is supported on the outer circumferential surface of the eccentric portion 142.

The mounted vane 133 partitions the compression space defined between the cylinder 132 and the eccentric portion 142 into the suction pocket S and the compression pocket D. The horizontal suction passage 142B of the eccentric portion 142 explained above is located to communicate with the suction pocket S, and the outlet port and the discharge valve 135A of the upper bearing cover 135 are located to communicate with the compression pocket D. As described above, they are preferably located adjacent to the vane 133 to reduce the dead volume.

Therefore, when the rotor 131 is rotated by a rotating magnetic field between the rotor 131 and the stator 120 (see FIG. 1), the cylinder 132 connected to the rotor 131 by the upper bearing cover 135 is integrally rotated. The vane 133 is elastically supported in the vane mounting hole 132H of the cylinder 132 as well as on the outer circumferential surface of the eccentric portion 142. The cylinder 132 is rotated around the stationary shaft 141, and the vane 133 is rotated around the eccentric portion 142 along the outer circumferential surface thereof in sliding-contact. That is, the inner circumferential surface of the cylinder 132 and the outer circumferential surface of the eccentric portion 142 have corresponding portions. In every rotation of the cylinder 132, the corresponding portions are repeatedly brought into contact and distant positions. Accordingly, the suction pocket S is gradually increased such that the refrigerant or working fluid is sucked into the suction pocket S, and the compression pocket D is gradually decreased such that the refrigerant or working fluid therein is compressed and discharged.

Figure 5:
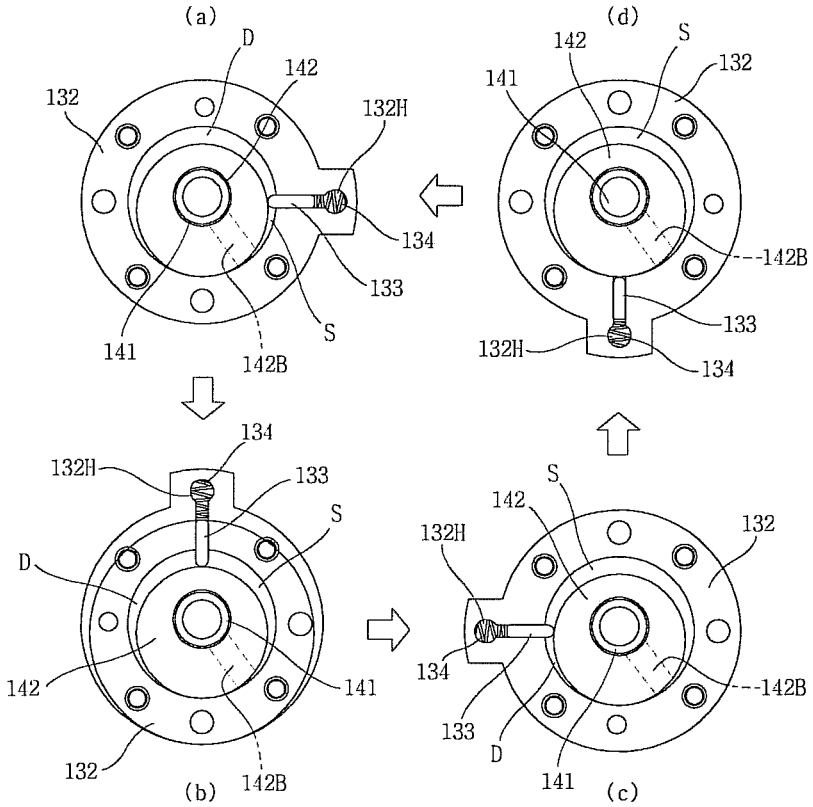
FIG. 5 is a plan view of an operation cycle of a compression mechanism unit in the first embodiment of the compressor according to the present invention.

FIG. 5 is a plan view of an operation cycle of the compression mechanism unit in the first embodiment of the compressor according to the present invention.

The suction, compression and discharge process of the compression mechanism unit will be described. As illustrated in FIG. 5, the cylinder 132 and the vane 133 are rotated and their relative positions are changed to (a), (b), (c) and (d) during one cycle. In more detail, when the cylinder 132 and the vane 133 are located in (a), the refrigerant or working fluid is sucked into the suction pocket S and compressed in the compression pocket D separated from the suction pocket S by the vane 134. When the cylinder 132 and the vane 133 are rotated to reach (b), the suction pocket S is increased and the compression pocket D is decreased such that the refrigerant or working fluid is sucked into the suction pocket S and compressed in the compression pocket D. When the cylinder 132 and the vane 133 are rotated to reach (c), the refrigerant or working fluid is continuously sucked into the suction pocket S. If the refrigerant or working fluid has a pressure over a set pressure in the compression pocket D, it is discharged through the outlet port and the discharge valve 135A (see FIG. 2) of the upper bearing cover 135 (see FIG. 2). The suction and discharge of the refrigerant or working fluid are almost done in (d). When the position is changed from (d) to (a), the vane 133 passes through the horizontal suction passage 142B provided in the eccentric portion 142.

In the compressor described above, as illustrated in FIGS. 1 to 5, since the rotary member 130 is suspended on the stationary member 140 and rotatably supported on the lower shaft holder 160, the portion of the rotary member 130 suspended on the stationary member 140 and the portion of the rotary member 130 supported on the lower shaft holder 160, i.e., the thrust surfaces should be essentially lubricated. Additionally, contact components of the rotary member 130, the stationary member 140 and the lower shaft holder 160 need to be lubricated.

Figure 6:
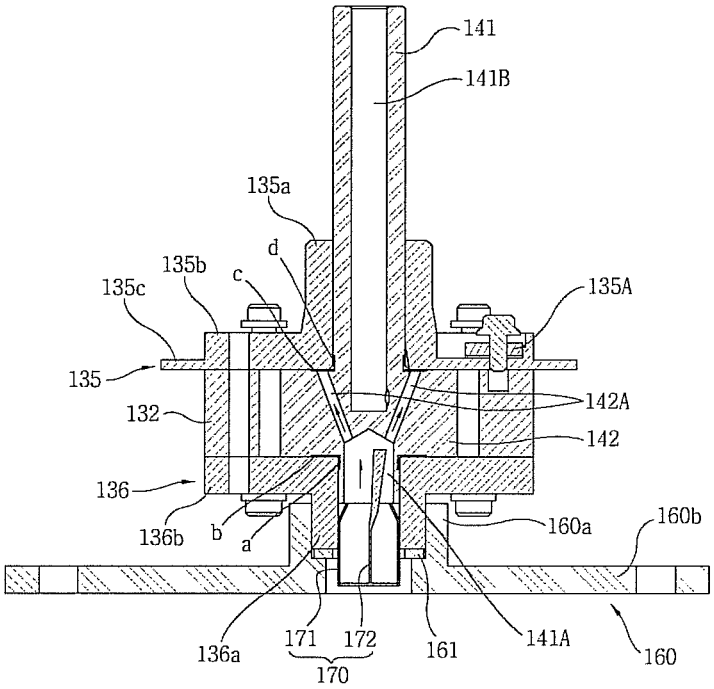
FIG. 6 is a side-sectional view of an example of a lubrication passage in the first embodiment of the compressor according to the present invention.
Figure 7:
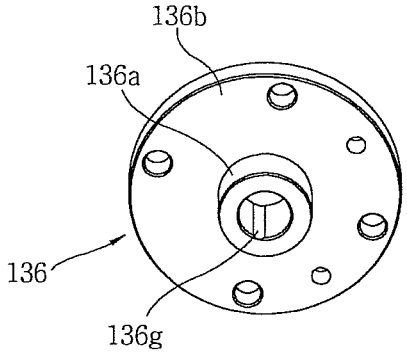
FIGS. 7 and 8 are perspective views of lubrication passages provided respectively in a lower bearing cover and an upper bearing cover in the first embodiment of the compressor according to the present invention.
Figure 8:
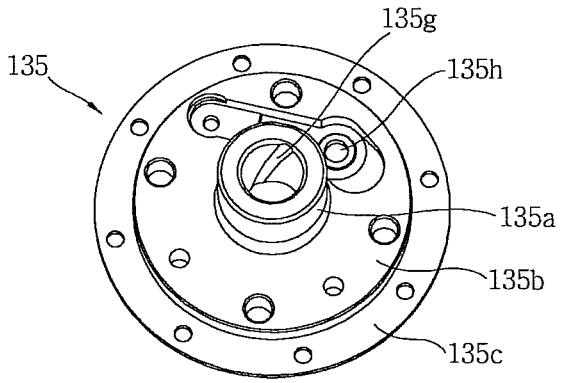

FIG. 6 is a side-sectional view of an example of a lubrication passage in the first embodiment of the compressor according to the present invention, and FIGS. 7 and 8 are perspective views of lubrication passages provided respectively in the lower bearing cover and the upper bearing cover in the first embodiment of the compressor according to the present invention.

As illustrated in FIGS. 6 to 8, preferably, the level of the oil stored in the hermetic container 110 (see FIG. 3) is maintained higher than at least the lower shaft holder 160 (see FIG. 3) or the bottommost end of the lower shaft portion 136*a* of the lower bearing cover 136. As described above, since the lower shaft portion 136*a* of the lower bearing cover 136 is accommodated in the bearing portion 160*a* (see FIG. 3) of the lower shaft holder 160 (see FIG. 3), their contact surfaces, i.e., their journal surfaces and thrust surfaces are bearing-supported, respectively, and immersed in the oil. As such, there is no need to provide a special lubrication passage.

However, it is preferable to provide a lubrication passage to contact portions of the rotary member 130 (see FIG. 1) and the stationary member 140 (see FIG. 1). The lubrication passage can be divided into a lower lubrication passage, an oil supply member, and an upper lubrication passage. The lower lubrication passage is provided to supply the oil stored in the lower portion of the hermetic container 110 (see FIG. 1) to contact portions of the lower bearing cover 136, and the stationary shaft 141 and the eccentric portion 142, the oil supply member 170 is provided to pump the oil when it is rotated with the rotary member 130 (see FIG. 1), and the upper lubrication passage is provided to supply the oil pumped by the oil supply member 170 to contact portions of the upper bearing cover 135, and the stationary shaft 141 and the eccentric portion 142.

The lower lubrication passage includes a first oil supply passage 141A which is a vertical hollow space of a lower portion of the stationary shaft 141, an oil supply hole (not shown) penetrated through the lower portion of the stationary shaft 141 in the radial direction to communicate with the oil supply passage 141A, and first oil supply grooves a and b formed in a bottom surface of the eccentric portion 142 brought into contact with the lower bearing cover 136 and an outer circumferential surface of the stationary shaft 141 directly below the eccentric portion 142 so as to communicate with the oil supply hole. Here, the first oil supply grooves a and b may be formed in any of the contact portions of the lower bearing cover 136, and the stationary shaft 141 and the eccentric portion 142, but are preferably formed as an annular groove portion having a side section of '⌉' in the outer circumferential surface of the lower portion of the stationary shaft 141 and the bottom surface of the eccentric portion 142 of a relatively large thickness and an easy machining property. Preferably, the oil level is so high that the lower bearing cover 136 is immersed in the oil. Moreover, even if the oil does not pass through the first oil supply passage 141A and the oil supply hole, in order to supply the oil to the first oil supply grooves a and b, as illustrated in FIG. 7, a vertical linear or spiral groove 136*g* may be formed in an inner circumferential surface of the lower shaft portion 136*a* of the lower bearing cover 136 to communicate with the first oil supply grooves a and b.

The oil supply member 170 includes a cylindrical hollow shaft portion 171 fitted into the lower shaft portion 136*a* of the lower bearing cover 136, and a propeller 172 installed in the hollow shaft portion 171 to supply the oil through a passage between the propeller 172 and the hollow shaft portion 171 by a rotation force. Therefore, the oil supply member 170 is immersed in the oil and rotated like the lower bearing cover 136 such that the oil is lifted through the oil supply member 170.

The upper lubrication passage includes a first oil supply passage 141A of the stationary shaft 141, two or more second oil supply passages 142A of the eccentric portion 142 extended to a top surface of the eccentric portion 142 to communicate with the first oil supply passage 141A of the stationary shaft 141, and second oil supply grooves c and d formed in a top surface of the eccentric portion 142 brought into contact with the upper bearing cover 135 and an outer circumferential surface of the stationary shaft 141 directly over the eccentric portion 142 so as to communicate with the second oil supply passages 142A of the eccentric portion 142. Preferably, the second oil supply passages 142A provided in the eccentric portion 142 are installed without overlapping with the horizontal suction passage 142B (see FIG. 3) provided in the eccentric portion 142. Likewise, the second oil supply grooves c and d may be formed in any of the contact portions of the upper bearing cover 135, and the stationary shaft 141 and the eccentric portion 142, but are preferably formed as an annular groove portion having a side section of '⌊' in the outer circumferential surface of the upper portion of the stationary shaft 141 and the top surface of the eccentric portion 142 of a relatively large thickness and an easy machining property. In addition, as illustrated in FIG. 8, a vertical linear or spiral groove 135*g* may be formed in an inner circumferential surface of the upper shaft portion 135*a* of the upper bearing cover 135 to communicate with the second oil supply grooves c and d, such that the oil stored in the second oil supply grooves c and d is lifted to lubricate a contact surface between the upper shaft portion 135*a* of the upper bearing cover 135 and the upper portion of the stationary shaft 141.

Accordingly, since the level of the oil stored in the lower portion of the hermetic container 110 (see FIG. 1) is higher than the oil supply hole including the end of the lower shaft portion 136*a* of the lower bearing cover 136, the oil is introduced into the first oil supply grooves a and b through the first oil supply passage 141A of the stationary shaft 141, the oil supply hole of the stationary shaft 141, and the groove 136*g* of the lower bearing cover 136. Here, as the lower shaft portion 136*a* of the lower bearing cover 136 is immersed in the oil, the oil lubricates between the lower shaft portion 136*a* and the lower shaft holder 160 (see FIG. 3). The oil collected in the first oil supply grooves a and b and the groove 136*g* lubricates between the rotatably-installed lower bearing cover 136, and the stationary shaft 141 and the eccentric portion 142. Moreover, as the rotary member 130 (see FIG. 1) is rotated, the oil is pumped by the oil supply member 170, introduced into the second oil supply grooves c and d through the first oil supply passage 141A of the stationary shaft 141 and the second oil supply passages 142A of the eccentric portion 142, and lifted through the groove 135*g* of the upper bearing cover 135. Here, the oil collected in the second oil supply grooves c and d and the groove 135*g* lubricates between the rotatably-installed upper bearing cover 135, and the stationary shaft 141 and the eccentric portion 142.

Figure 9:
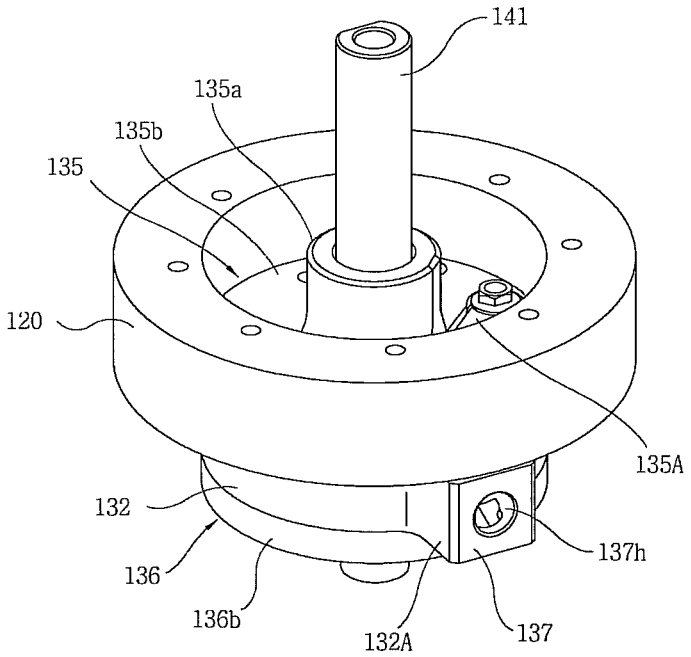
FIG. 9 is a perspective view of an example of a vane lubrication structure in the first embodiment of the compressor according to the present invention.

FIG. 9 is a perspective view of an example of a vane lubrication structure in the first embodiment of the compressor according to the present invention.

The vane lubrication structure in the first embodiment of the compressor according to the present invention will be described with reference to FIGS. 4 and 9.

A vane escape protrusion portion 132A is provided on an outer circumferential surface of the cylinder 132 to protrude therefrom so as to secure an installation space of the vane 133, a vane mounting hole 132H is provided to penetrate from an inner circumferential surface of the cylinder 132 to an outer circumferential surface of the vane escape protrusion portion 132A, and a vane spring stopper 137 is provided to block the vane mounting hole 132H extended to the outer circumferential surface of the vane escape protrusion portion 132A so as to elastically support the vane 133 in the vane mounting hole 132H by the vane spring 134. The vane spring stopper 137 is provided with an oil supply hole 137*h* communicating with the inner space of the hermetic container 110 (see FIG. 1). Here, preferably, the oil level is maintained higher than the oil supply hole 137*h* of the vane spring stopper 137 during the operation of the compressor such that the oil stored in the hermetic container 110 (see FIG. 1) is introduced through the oil supply hole 137*h* of the vane spring stopper 137. Although the compressor is operated at a high speed, the oil level should be maintained higher than at least the bottommost end of the oil supply hole 137*h* of the vane spring stopper 137. However, when the oil is introduced into the vane mounting hole 132H through the oil supply hole 137*h* of the vane spring stopper 137, it is mixed with the compression refrigerant and discharged to the outside, which makes it difficult to maintain the oil level over a certain height. Preferably, an oil recovery structure is applied to maintain a proper amount of oil in the hermetic container 110 (see FIG. 1).

The oil recovery structure of the above embodiment will be described. When the compression refrigerant discharged through the outlet port and the discharge valve 135A of the upper bearing cover 135 collides against an oil separation plate 180 (see FIG. 1) installed directly over the rotor 131, the oil is separated from the compression refrigerant. The refrigerant separated from the oil is discharged through holes 180*h* (see FIG. 3) provided in the oil separation plate 180 (see FIG. 1), and the oil separated from the refrigerant is dropped from the oil separation plate 180 (see FIG. 1) to the rotor 131 or the upper bearing cover 135 and recovered to the lower portion of the hermetic container 110 (see FIG. 1) through an oil recovery passage between the components. Here, the oil recovery passage is provided as a gap between the stator 120 (see FIG.

1) and the rotor 131, or a series of jig mounting holes (not shown) provided in the cylinder 132 and the upper and lower bearing covers 135 and 136 to communicate with each other in the vertical direction such that a jig is mounted therein to bolt-fasten the cylinder 132 to the upper and lower bearing covers 135 and 136.

Another example of the vane lubrication structure will be described. Preferably, the lower bearing cover 136 is installed without covering a part of a bottom surface of the vane mounting hole 132H of the cylinder 132, and the level of the oil in the hermetic container 110 (see FIG. 1) is maintained to be higher than the lower bearing cover 136 and to make the bottommost end of the vane mounting hole 132H immersed in the oil. Here, since the vane mounting hole 132H is provided in the vane escape protrusion portion 132A protruding from the circular cylinder 132, even if the lower cover portion 136*b* of the lower bearing cover 136 is formed in the shape of a disk, the lower bearing cover 136 can be installed without covering a part of the vane mounting hole 132H extended to the vane escape protrusion portion 132A. Additionally, when the lower cover portion 136*b* of the lower bearing cover 136 is formed in the shape of a disk, if an outer circumferential portion thereof is provided with a stepped portion, the lower bearing cover 136 can be installed without covering a part of the vane mounting hole 132H extended to the vane escape protrusion portion 132A.

A further example of the vane lubrication structure will be described. Preferably, the upper bearing cover 135 is installed without covering a part of a top surface of the vane mounting hole 132H of the cylinder 132, and the level of the oil in the hermetic container 110 (see FIG. 1) is maintained to be higher than the upper bearing cover 135 and to make the topmost end of the vane mounting hole 132H immersed in the oil.

Figure 10:
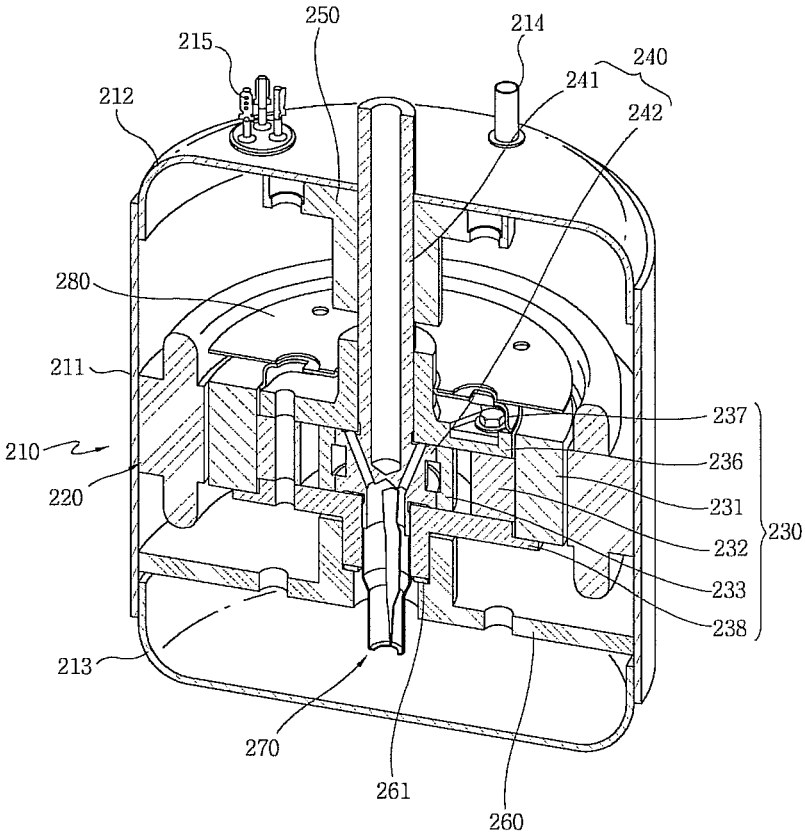
FIG. 10 is a side-sectional view of a second embodiment of the compressor according to the present invention.
Figure 11:
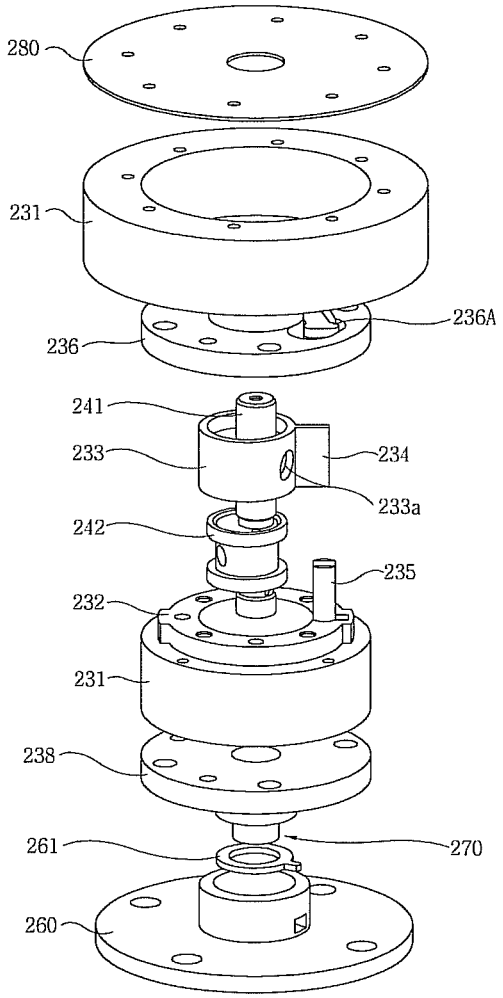
FIG. 11 is an exploded perspective view of the second embodiment of the compressor according to the present invention.
Figure 12:
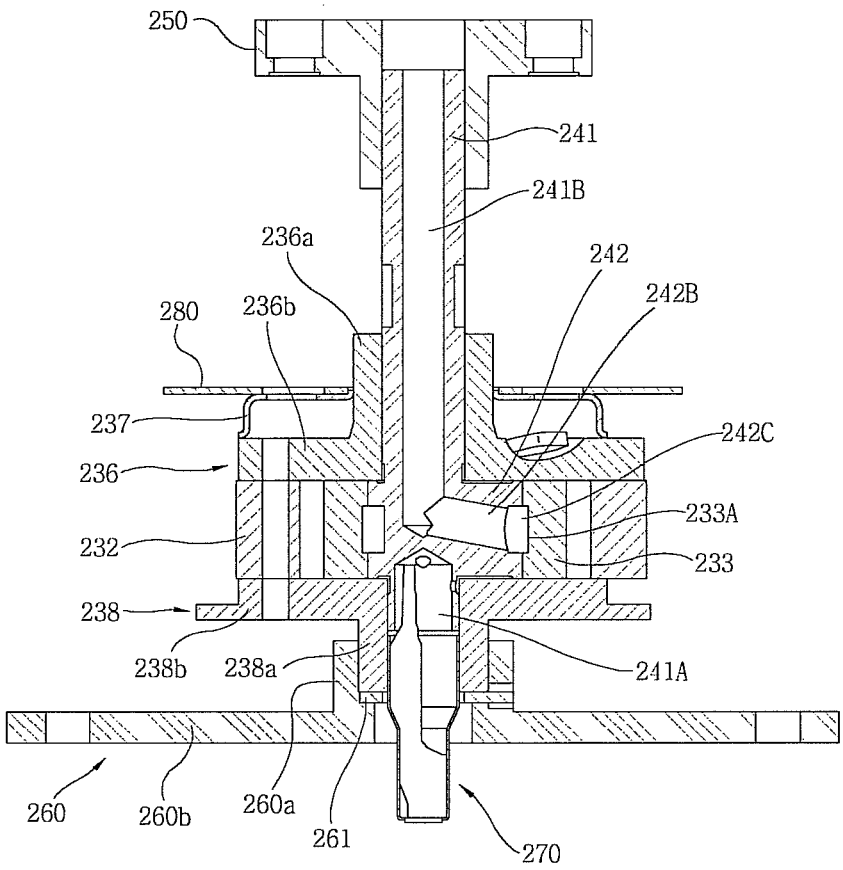
FIG. 12 is a side-sectional view of the second embodiment of the compressor according to the present invention.

FIGS. 10 to 12 are views of a second embodiment of the compressor according to the present invention.

Like the first embodiment, as illustrated in FIGS. 10 to 12, the second embodiment of the compressor according to the present invention includes a hermetic container 210, a stator 220 fixed in the hermetic container 210, a rotary member 230 installed inside the stator 220 to be rotated by a rotating electromagnetic field from the stator 220 and compressing the refrigerant, a stationary member 240, the rotary member 230 being suspended on its outer circumferential surface, top and bottom ends of a stationary shaft 241 being immovably fixed to the hermetic container 210, an upper shaft holder 250 fixing the top end of the stationary shaft 241 to the inside of the hermetic container 210, and a lower shaft holder 260 spaced apart from the bottom end of the stationary shaft 241 and fixed to the inside of the hermetic container 210 such that the rotary member 230 is rotatably supported on its top surface. Here, a motor mechanism unit supplying power through an electrical action includes the stator 220 and a rotor 231 of the rotary member 230, and a compression mechanism unit compressing the refrigerant through a mechanical action includes the rotary member 230 and the stationary member 240. Therefore, the motor mechanism unit and the compression mechanism unit are installed in the radial direction, which reduces the overall height of the compressor.

Like the hermetic container 110 of the first embodiment, the hermetic container 210 includes a body portion 211 and upper and lower shells 212 and 213. The compressor is implemented as a high-pressure type such that the high-pressure refrigerant is filled in the hermetic container 210. That is, the stationary shaft 241 is provided in the center of the upper shell 212 to be exposed therefrom, which is an example of a suction pipe through which the refrigerant is sucked, a discharge pipe 214 through which the high-pressure refrigerant is discharged is provided at one side of the upper shell 212, and a terminal 215 is provided to supply power to the stator 220. Here, there is no need that the stationary shaft 241 should excessively protrude to the outside of the hermetic container 210. Preferably, an appropriate fixing structure is installed on the outside of the hermetic container 210 and connected to an external refrigerant pipe.

The stator 220 is identically constructed as that of the first embodiment, and thus its detailed description will be omitted.

The rotary member 230 includes a cylinder-type rotor 231 and 232, a roller 233, a vane 234, a bush 235, an upper bearing cover 236 and a muffler 237, and a lower bearing cover 238. The cylinder-type rotor 231 and 232 includes a rotor 231 having a plurality of permanent magnets in the axial direction to be rotated by the rotating electromagnetic field from the stator 220, and a cylinder 232 located inside the rotor 231, integrally rotated with the rotor 231 and having a compression space therein. The rotor 231 and the cylinder 232 may be separately formed and die-matched or integrally formed in the form of a powder-sintered body or an iron piece-stacked body. The roller 233 is formed in a cylindrical shape and rotatably mounted on an outer circumferential surface of an eccentric portion 242 of the stationary member 240 explained below. For this purpose, it is preferable to apply a lubrication structure to between the roller 233 and the eccentric portion 242. Here, suction guide passages 233A and 242C through which the refrigerant can be sucked are provided between the roller 233 and the eccentric portion 242, and an inlet port 233*a* is provided in the roller 233 to communicate with the suction guide passages 233A and 242C. The vane 234 is integrally formed on an outer circumferential surface of the roller 233 to be expanded in the radial direction and located at one side of the inlet port 233*a* of the roller 233, and fitted into a vane mounting hole 232H provided in an inner circumferential surface of the cylinder-type rotor 231 and 232 or the cylinder 232. The bushes 235 are installed to support both sides of an end portion of the vane 234 fitted into the vane mounting hole 232H of the cylinder-type rotor 231 and 232. A lubrication structure is applied such that the vane 234 is smoothly moved between the vane mounting hole 232H of the cylinder-type rotor 231 and 232 and the bushes 235.

The upper bearing cover 236 and the muffler 237, and the lower bearing cover 238 are coupled to the cylinder-type rotor 231 and 232 in the axial direction, define a compression space between the cylinder-type rotor 231 and 232, and the roller 233 and the vane 234, and are in journal-bearing or thrust-bearing contact with the stationary member 240. In addition, an outlet port (not shown) through which the refrigerant compressed in the compression space can be discharged and a discharge valve 236A installed thereon are provided at the upper bearing cover 236. Preferably, the outlet port of the upper bearing cover 236 is located adjacent to the vane 233 to reduce the dead volume. The muffler 237 is coupled to a top surface of the upper bearing cover 236, and a discharge chamber which can reduce the noise caused by the opening and closing of the discharge valve 236A and the noise caused by the flow of the high-pressure refrigerant is provided between the upper bearing cover 236 and the muffler 237 to communicate with outlet ports (not shown) provided in the upper bearing cover 236 and the muffler 237, respectively. The upper bearing cover 236 and the muffler 237 are coupled to a top surface of the cylinder-type rotor 231 and 232, and the lower bearing cover 237 is coupled to a bottom surface of the cylinder-type rotor 231 and 232. They are fastened to the cylinder-type rotor 231 and 232 at a time by a fastening member such as a long bolt, etc.

The stationary member 240 includes the stationary shaft 241 formed in a cylindrical shape, and the eccentric portion 242 protruding from the stationary shaft 241 in the entire radial direction of the stationary shaft 241 to have a cylindrical shape of a greater diameter than that of the cylinder of the stationary shaft 241 and eccentrically formed on the stationary shaft 241. A first oil supply passage 241A through which the oil stored in the hermetic container 210 can be supplied is formed at a lower portion of the stationary shaft 241, and a vertical suction passage 241B through which the low-pressure refrigerant can be sucked is formed at an upper portion of the stationary shaft 241. The first oil supply passage 241A and the vertical suction passage 241B are isolated from each other, which prevents the oil from being discharged with the refrigerant. The eccentric portion 242 is expanded in the entire radial direction of the stationary shaft 241. A horizontal suction passage 242B is extended in the radial direction of the eccentric portion 242 to an outer circumferential surface thereof to communicate with the vertical suction passage 241B of the stationary shaft 241. While the roller 233 is rotated along the outer circumferential surface of the eccentric portion 242, since the annular suction guide passages 233A and 242C are provided between the inner circumferential surface of the roller 233 and the outer circumferential surface of the eccentric portion 242, the refrigerant can be introduced into the compression space through the vertical suction passage 241B of the stationary shaft 241, the horizontal suction passage 242B of the eccentric portion 242, and the suction guide passages 233A and 242C between the roller 233 and the eccentric portion 242. Since top and bottom surfaces of the eccentric portion 242 are brought into contact with the upper and lower bearing covers 236 and 238 and operated as thrust surfaces, it is preferable to form a lubrication oil supply passage on the top and bottom surfaces of the eccentric portion 242, and since the roller 233 is rotatably installed in contact with the outer circumferential surface of the eccentric portion 242, it is preferable to form a lubrication oil supply passage inside the eccentric portion 242 to extend to the outer circumferential surface thereof.

The upper and lower shaft holders 250 and 260 have the same structure as those of the first embodiment. The rotary member 230 is suspended on the stationary member 240. Next, the upper shaft holder 250 is fixedly welded to an upper portion of the hermetic container 210 after an upper portion of the stationary shaft 241 is fitted thereinto, and the lower shaft holder 260 is fixedly welded to a lower portion of the hermetic container 210 after the lower bearing cover 238 is rotatably supported thereon.

Meanwhile, a structure in which the rotary member 230 is rotatably coupled to the stationary member 240 will be described. The upper and lower bearing covers 236 and 238 are rotatably installed on the stationary member 230 and the lower shaft holder 260. In more detail, the upper bearing cover 236 includes an upper shaft portion 236*a* having a journal bearing on its inner circumferential surface enclosing an upper portion of the stationary shaft 241, and an upper cover portion 236*b* having a thrust bearing on its bottom surface brought into contact with a top surface of the eccentric portion 242. The cylinder-type rotor 231 and 232 is bolt-fastened to a bottom surface of the upper cover portion 236*b*. Additionally, the lower bearing cover 238 includes a lower shaft portion 238*a* having a journal bearing on its inner circumferential surface enclosing a lower portion of the stationary shaft 241, and a lower cover portion 238*b* having a thrust bearing on its top surface brought into contact with a bottom surface of the eccentric portion 242. Further, the lower shaft holder 260 includes a cylindrical bearing portion 260*a* having a stepped portion and enclosing the lower shaft portion 238*a*, and a mounting portion 260*b* expanded in the radial direction of the bearing portion 260*a* and fixedly welded to the inside of the hermetic container 210. Here, a journal bearing journal-supporting the outer circumferential surface of the lower shaft portion 238*a* is provided on an inner circumferential surface of the bearing portion 260*a*, and a thrust bearing thrust-supporting a bottom end of the lower shaft portion 238*a* is provided on the stepped bottom surface of the bearing portion 260*a*, or a thrust bearing 261 formed in a plate shape may be inserted therebetween.

Accordingly, when the upper and lower bearing covers 236 and 238 are coupled to the cylinder-type rotor 231 and 232 and the stationary member 240 in the axial direction, the bottom surface of the upper cover portion 236*b* of the upper bearing cover 236 is bolt-fastened in contact with the top surface of the cylinder-type rotor 231 and 232, and the lower cover portion 238*b* of the lower bearing cover 238 is bolt-fastened in contact with the bottom surface of the cylinder-type rotor 231 and 232. Here, the upper shaft portion 236*a* is journal-bearing supported on the upper portion of the stationary shaft 241 and the upper cover portion 236*b* is thrust-supported on the top surface of the eccentric portion 242 such that the upper bearing cover 236 is rotatably installed with respect to the stationary shaft 241, and the lower shaft portion 238*a* is journal-bearing supported on the lower portion of the stationary shaft 241 and the lower cover portion 238*b* is thrust-supported on the bottom surface of the eccentric portion 242 such that the lower bearing cover 238 is rotatably installed with respect to the stationary member 240. Furthermore, the lower shaft portion 238*a* of the lower bearing cover 238 is fitted into the bearing portion 260*a* of the lower shaft holder 260. As the journal surfaces or thrust surfaces brought into contact with each other are bearing-supported, the lower bearing cover 238 is rotatably supported with respect to the lower shaft holder 260.

Figure 13:
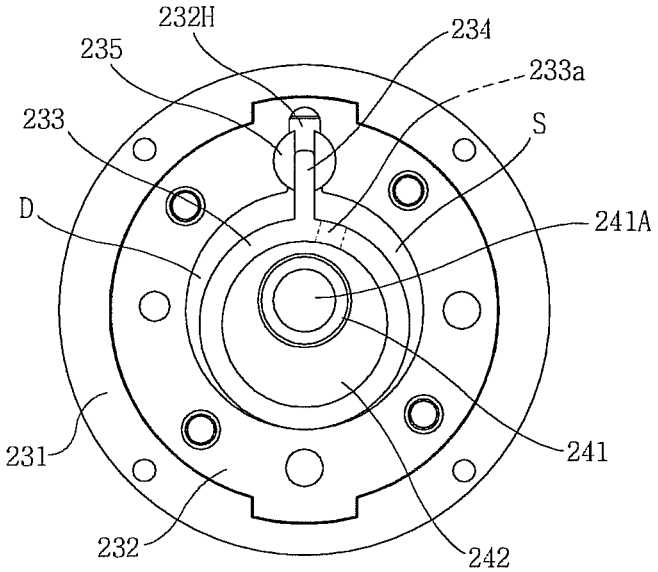
FIG. 13 is a plan view of a vane mounting structure in the second embodiment of the compressor according to the present invention.

FIG. 13 is a plan view of a vane mounting structure in the second embodiment of the compressor according to the present invention.

The mounting structure of the vane 234 will be described with reference to FIG. 13. The vane mounting hole 232H is formed in an inner circumferential surface of the cylinder-type rotor 231 and 232 to be elongated in the radial direction and penetrated in the axial direction, the pair of bushes 235 are fitted into the vane mounting hole 232H, and the vane 234 integrally formed on an outer circumferential surface of the roller 233 is fitted between the bushes 235. Here, a compression space is defined between the cylinder-type rotor 231 and 232 and the roller 233 and divided into a suction pocket S and a compression pocket D by the vane 234. The inlet port 233*a* of the roller 233 is located at one side of the vane 234 to communicate with the suction pocket S, and the outlet port and the discharge valve 236A (see FIG. 11) of the upper bearing cover 236 (see FIG. 11) described above are located at the other side of the vane 234 to communicate with the compression pocket D. Preferably, they are located adjacent to the vane 234 to reduce the dead volume. In the compressor of the present invention, the vane 234 integrally formed with the roller 233 is slidably assembled between the bushes 235. This can prevent a friction loss caused by sliding-contact generated in the conventional rotary compressor in which the vane separately formed from the roller or the cylinder is supported by the spring and reduce refrigerant leakage between the suction pocket S and the compression pocket D.

Accordingly, when the cylinder-type rotor 231 and 232 is applied with a rotation force by a rotating magnetic field between the rotor and the stator 220 (see FIG. 10), it is rotated.

In a state where the vane 234 is fitted into the vane mounting hole 232H of the cylinder-type rotor 231 and 232, it transfers the rotation force of the cylinder-type rotor 231 and 232 to the roller 233. Here, the vane 234 is linearly reciprocated between the bushes 235 due to the rotation of the rotor and the roller. That is, an inner circumferential surface of the cylinder-type rotor 231 and 232 and an outer circumferential surface of the rotor 233 have corresponding portions. In every rotation of the cylinder-type rotor 231 and 232 and the roller 233, the corresponding portions are repeatedly brought into contact and distant positions. Therefore, the suction pocket S is gradually increased such that the refrigerant or working fluid is sucked into the suction pocket S, and the compression pocket D is gradually decreased such that the refrigerant or working fluid therein is compressed and discharged.

Figure 14:
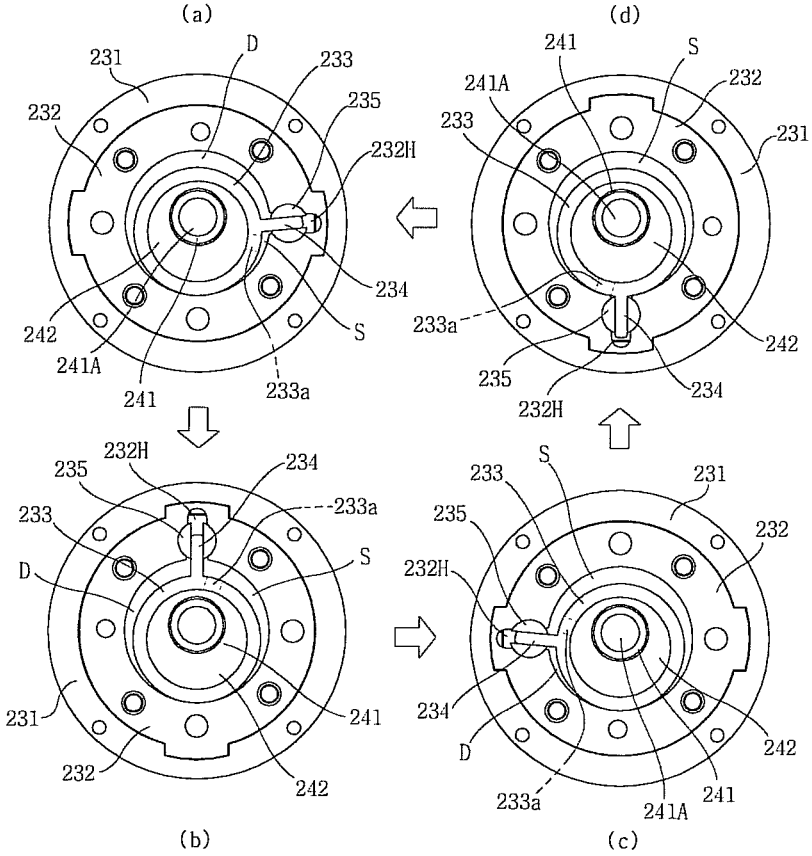
FIG. 14 is a plan view of an operation cycle of a compression mechanism unit in the second embodiment of the compressor according to the present invention.

FIG. 14 is a plan view of an operation cycle of the compression mechanism unit in the second embodiment of the compressor according to the present invention.

The suction, compression and discharge process of the compression mechanism unit will be described. As illustrated in FIG. 14, the cylinder-type rotor 231 and 232 and the roller 233 are rotated and their relative positions are changed to (a), (b), (c) and (d) during one cycle. In more detail, when the cylinder-type rotor 231 and 232 and the roller 233 are located in (a), the refrigerant or working fluid is sucked into the suction pocket S through the inlet port 233*a* of the roller 233 and compressed in the compression pocket D separated from the suction pocket S by the vane 234. When the cylinder-type rotor 231 and 232 and the roller 233 are rotated to reach (b), the suction pocket S is increased and the compression pocket D is decreased such that the refrigerant or working fluid is sucked into the suction pocket S and compressed in the compression pocket D. When the cylinder-type rotor 231 and 232 and the roller 233 are rotated to reach (c), the refrigerant or working fluid is continuously sucked into the suction pocket S. If the refrigerant or working fluid has a pressure over a set pressure in the compression pocket D, it is discharged through the outlet port and the discharge valve 236A (see FIG. 11) of the upper bearing cover 236 (see FIG. 8). The suction and discharge of the refrigerant or working fluid are almost done in (d).

In the compressor described above, as illustrated in FIGS. 10 to 14, since the rotary member 230 is suspended on the stationary member 240 and rotatably supported on the lower shaft holder 260, the portion of the rotary member 230 suspended on the stationary member 240 and the portion of the rotary member 230 supported on the lower shaft holder 260, i.e., the thrust surfaces should be essentially lubricated. In addition, contact components of the rotary member 230, the stationary member 240 and the lower shaft holder 260 need to be lubricated.

Figure 15:
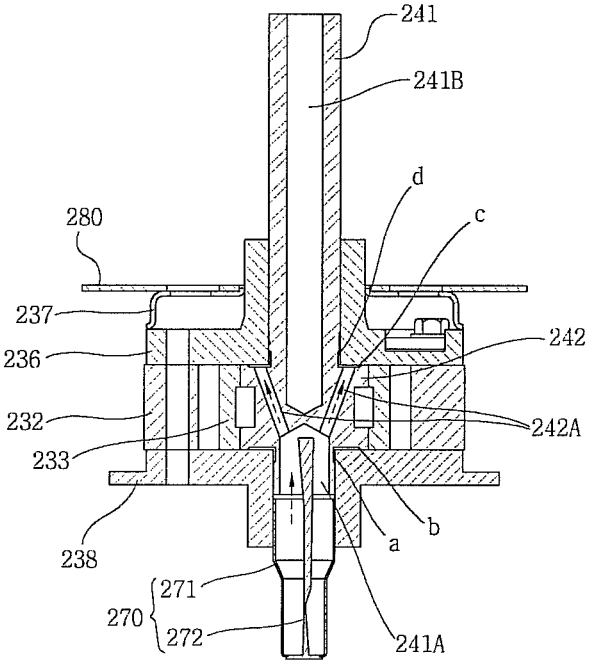
FIG. 15 is a side-sectional view of an example of a lubrication passage in the second embodiment of the compressor according to the present invention.
Figure 16:
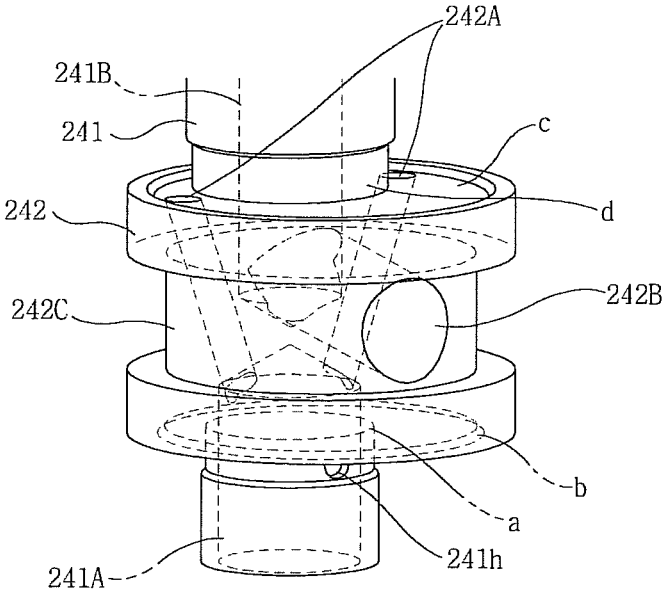
FIG. 16 is a perspective view of a lubrication passage provided in a stationary member in the second embodiment of the compressor according to the present invention.
Figure 17:
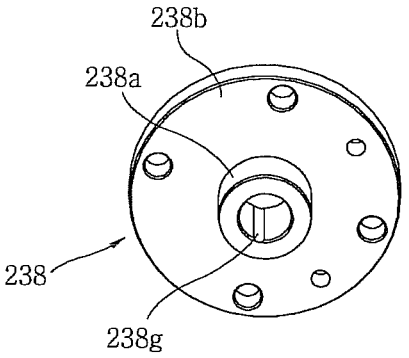
FIGS. 17 and 18 are perspective views of lubrication passages provided respectively in a lower bearing cover and an upper bearing cover in the second embodiment of the compressor according to the present invention.
Figure 18:
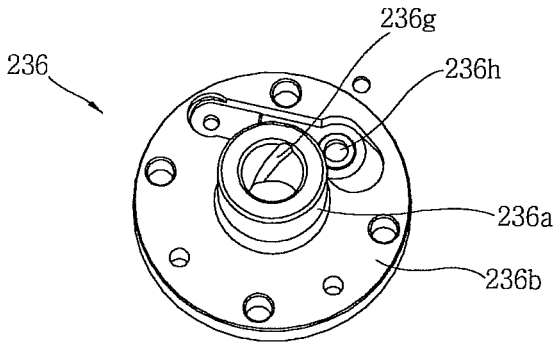

FIG. 15 is a side-sectional view of an example of a lubrication passage in the second embodiment of the compressor according to the present invention, and FIGS. 16 to 18 are perspective views of lubrication passages provided respectively in the stationary member, the lower bearing cover and the upper bearing cover in the second embodiment of the compressor according to the present invention.

As illustrated in FIGS. 15 to 18, preferably, the level of the oil stored in the hermetic container 210 (see FIG. 10) is maintained higher than at least the lower shaft holder 260 (see FIG. 12) or the bottommost end of the lower shaft portion 238*a* of the lower bearing cover 238. As described above, since the lower shaft portion 238*a* of the lower bearing cover 238 is accommodated in the bearing portion 260*a* (see FIG. 12) of the lower shaft holder 260 (see FIG. 12), their contact surfaces, i.e., their journal surfaces and thrust surfaces are bearing-supported, respectively, and immersed in the oil. As such, there is no need to provide a special lubrication passage.

However, it is preferable to provide a lubrication passage to contact portions of the rotary member 230 (see FIG. 10) and the stationary member 240 (see FIG. 10). The lubrication passage can be divided into a lower lubrication passage, an oil supply member, and an upper lubrication passage. The lower lubrication passage is provided to supply the oil stored in the lower portion of the hermetic container 210 (see FIG. 10) to contact portions of the lower bearing cover 238, and the stationary shaft 241 and the eccentric portion 242, the oil supply member 270 is provided to pump the oil when it is rotated with the rotary member 230 (see FIG. 10), and the upper lubrication passage is provided to supply the oil pumped by the oil supply member 270 to contact portions of the upper bearing cover 236, and the stationary shaft 241 and the eccentric portion 242.

The lower lubrication passage includes a first oil supply passage 241A which is a vertical hollow space of a lower portion of the stationary shaft 241, an oil supply hole 241*h* penetrated through the lower portion of the stationary shaft 241 in the radial direction to communicate with the oil supply passage 241A, and first oil supply grooves a and b formed in a bottom surface of the eccentric portion 242 brought into contact with the lower bearing cover 238 and an outer circumferential surface of the stationary shaft 241 directly below the eccentric portion 242 so as to communicate with the oil supply hole 241*h*. Here, the first oil supply grooves a and b may be formed in any of the contact portions of the lower bearing cover 238, and the stationary shaft 241 and the eccentric portion 242, but are preferably formed as an annular groove portion having a side section of '⌉' in the outer circumferential surface of the lower portion of the stationary shaft 241 and the bottom surface of the eccentric portion 242 of a relatively large thickness and an easy machining property. Preferably, the oil level is so high that the lower bearing cover 236 is immersed in the oil. Moreover, even if the oil does not pass through the first oil supply passage 241A and the oil supply hole 241*h*, in order to supply the oil to the first oil supply grooves a and b, as illustrated in FIG. 17, a vertical linear or spiral groove 238*g* may be formed in an inner circumferential surface of the lower shaft portion 238*a* of the lower bearing cover 238 to communicate with the first oil supply grooves a and b.

The oil supply member 270 includes a cylindrical hollow shaft portion 271 fitted into the lower shaft portion 238*a* of the lower bearing cover 238, and a propeller 272 installed in the hollow shaft portion 271 to supply the oil through a passage between the propeller 272 and the hollow shaft portion 271 by a rotation force. Therefore, the oil supply member 270 is immersed in the oil and rotated like the lower bearing cover 238 such that the oil is lifted through the oil supply member 270.

The upper lubrication passage includes a first oil supply passage 241A of the stationary shaft 241, two or more second oil supply passages 242A of the eccentric portion 242 extended to a top surface of the eccentric portion 242 to communicate with the first oil supply passage 241A of the stationary shaft 241, and second oil supply grooves c and d formed in a top surface of the eccentric portion 242 brought into contact with the upper bearing cover 236 and an outer circumferential surface of the stationary shaft 241 directly over the eccentric portion 242 so as to communicate with the second oil supply passages 242A of the eccentric portion 242. Preferably, the second oil supply passages 242A provided in the eccentric portion 242 are installed without overlapping with the horizontal suction passage 242B provided in the eccentric portion 242. Likewise, the second oil supply grooves c and d may be formed in any of the contact portions of the upper bearing cover 236, and the stationary shaft 241 and the eccentric portion 242, but are preferably formed as an annular groove portion having a side section of '] ' in the outer circumferential surface of the upper portion of the stationary shaft 241 and the top surface of the eccentric portion 242 of a relatively large thickness and an easy machining property. In addition, as illustrated in FIG. 18, a vertical linear or spiral groove 236*g* may be formed in an inner circumferential surface of the upper shaft portion 236*a* of the upper bearing cover 236 to communicate with the second oil supply grooves c and d, such that the oil stored in the second oil supporting grooves c and d is lifted to lubricate a contact surface between the upper shaft portion 236*a* of the upper bearing cover 236 and the upper portion of the stationary shaft 241.

Accordingly, since the level of the oil stored in the lower portion of the hermetic container 210 (see FIG. 10) is higher than the oil supply hole 241*h* including the end of the lower shaft portion 238*a* of the lower bearing cover 238, the oil is introduced into the first oil supply grooves a and b through the first oil supply passage 241A of the stationary shaft 241, the oil supply hole 241*h* of the stationary shaft 241, and the groove 238*g* of the lower bearing cover 238. Here, as the lower shaft portion 238*a* of the lower bearing cover 238 is immersed in the oil, the oil lubricates between the lower shaft portion 238*a* and the lower shaft holder 260 (see FIG. 12). The oil collected in the first oil supply grooves a and b and the groove 238*g* lubricates between the rotatably-installed lower bearing cover 238, and the stationary shaft 241 and the eccentric portion 242. Moreover, as the rotary member 230 (see FIG. 10) is rotated, the oil is pumped by the oil supply member 270, introduced into the second oil supply grooves c and d through the first oil supply passage 241A of the stationary shaft 241 and the second oil supply passages 242A of the eccentric portion 242, and lifted through the groove 236*g* of the upper bearing cover 236. Here, the oil collected in the second oil supply grooves c and d and the groove 236*g* lubricates between the rotatably-installed upper bearing cover 236, and the stationary shaft 241 and the eccentric portion 242.

Figure 19:
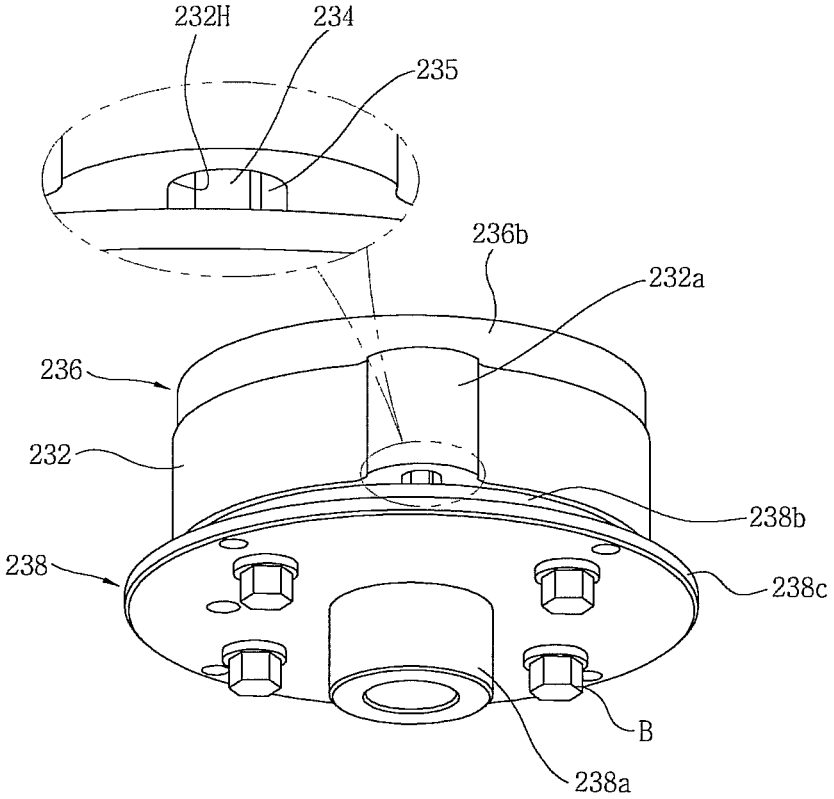
FIG. 19 is a perspective view of an example of a vane lubrication structure in the second embodiment of the compressor according to the present invention.

FIG. 19 is a perspective view of an example of a vane lubrication structure in the second embodiment of the compressor according to the present invention.

The vane lubrication structure in the second embodiment of the compressor according to the present invention will be described with reference to FIGS. 13 and 19.

A coupling protrusion 232*a* is provided on an outer circumferential surface of the cylinder 232 to protrude therefrom so as to be die-matched with an inner circumferential surface of the rotor 231, and a vane mounting hole 232H is provided to extend from an inner circumferential surface of the cylinder 232 to a part of the coupling protrusion 232*a*. The vane 234 is installed in the vane mounting hole 232H between the bushes 235 in contact, and the lower bearing cover 238 is installed without covering a part of a bottom surface of the vane mounting hole 232H of the cylinder 232. Here, since the vane mounting hole 232H is provided in the coupling protrusion 232*a* protruding from the circular cylinder 232, even if the lower cover portion 238*b* of the lower bearing cover 238 is formed in the shape of a disk, the lower bearing cover 238 can be installed without covering a part of the vane mounting hole 232H extended to the coupling protrusion 232*a*. Additionally, when the lower cover portion 238*b* of the lower bearing cover 238 is formed in the shape of a disk, if an outer circumferential portion thereof is provided with a stepped portion, the lower bearing cover 238 can be installed without covering a part of the vane mounting hole 232H extended to the coupling protrusion 232*a*. In addition, preferably, the level of the oil in the hermetic container 210 (see FIG. 10) is maintained to be higher than the lower bearing cover 238 and to make the bottommost end of the vane mounting hole 232H immersed in the oil, such that the oil is introduced through the bottom surface of the vane mounting hole 232H. However, when the oil is introduced into the vane mounting hole 232H through the bottom surface thereof, it is mixed with the compression refrigerant and discharged to the outside, which makes it difficult to maintain the oil level over a certain height. Preferably, an oil recovery structure is applied to maintain a proper amount of oil in the hermetic container 210 (see FIG. 10).

The oil recovery structure of the above embodiment will be described. When the compression refrigerant discharged through the outlet port of the upper bearing cover 236 and the outlet port of the muffler 237 (see FIG. 12) collides against an oil separation plate 280 (see FIG. 10) installed directly over the muffler 237 (see FIG. 12), the oil is separated from the compression refrigerant. The refrigerant separated from the oil is discharged through holes (not shown) provided in the oil separation plate 280 (see FIG. 10), and the oil separated from the refrigerant is dropped from the oil separation plate 280 (see FIG. 10) to the rotor 231 or the upper bearing cover 236 and recovered to the lower portion of the hermetic container 210 (see FIG. 10) through an oil recovery passage between the components. Here, the oil recovery passage is provided as a gap between the stator 220 (see FIG. 10) and the rotor 231, or a series of jig mounting holes (not shown) provided in the cylinder 232 and the upper and lower bearing covers 236 and 238 to communicate with each other in the vertical direction such that a jig is mounted therein to bolt-fasten the cylinder 232 to the upper and lower bearing covers 236 and 238.

Another example of the vane lubrication structure will be described. Preferably, the upper bearing cover 236 is installed without covering a part of a top surface of the vane mounting hole 232H of the cylinder 232, and the level of the oil in the hermetic container 210 (see FIG. 10) is maintained to be higher than the upper bearing cover 236 and to make the topmost end of the vane mounting hole 232H immersed in the oil.

The present invention has been described in connection with the exemplary embodiments and the accompanying drawings. However, the scope of the present invention is not limited thereto but is defined by the appended claims.

The invention claimed is:

1. A compressor, comprising:

a hermetic container that stores oil;

a stator fixed in the hermetic container;

a first stationary member including a stationary shaft having a top end immovably installed in the hermetic container and being elongated into the hermetic container, and an eccentric portion eccentrically formed on the stationary shaft;

a second stationary member spaced apart from a bottom end of the stationary shaft and immovably installed at a lower portion of the hermetic container;

a rotary member located between the stator and the first stationary member, rotated around the first stationary member by a rotating electromagnetic field from the stator, to compress refrigerant sucked into a compression space defined therein, rotatably supported by the second stationary member to apply a load to the second stationary member, and including upper and lower bearing covers that enclose a portion of the stationary shaft to form upper and lower portions of the compression space, the upper and lower bearing covers rotating around the stationary shaft with the rotary member, wherein a portion of the lower bearing cover is fitted between the stationary shaft and the second stationary member, the lower bearing cover being rotatably supported with respect to the stationary shaft and the second stationary member, and the stationary shaft being immovably fixed with respect to the second stationary member, wherein the rotary member comprises:

a cylinder type rotor rotatably supported on the first and second stationary members to rotate around the stationary shaft by a rotating electro electromagnetic field from the stator;

a roller applied with a rotational force of the cylinder-type rotor, rotated around the eccentric portion with the cylinder-type rotor, to define a compression space between the roller and the cylinder-type rotor;

a vane that transfers the rotational al force from the cylinder-type rotor to the roller and partitions the compression space into a suction pocket, into which the refrigerant is sucked, and a compression pocket, in and from which the refrigerant is compressed and discharged:

a vane mounting hole integrally formed with the roller to protrude from an outer circumferential surface of the roller toward the cylinder-type rotor so as to accommodate the vane and the upper and lower bearing covers;

a lubrication passage that guides the oil stored in the hermetic container to portions of the rotary member and the first stationary member or the second stationary member, which are brought into bearing-contact, by using a rotation force of the lower bearing cover; and an oil supply hole that enables a portion of the vane mounting hole to communicate with an inner space of the hermetic container such that the oil in the inner space is supplied to the vane mounting hole.

2. The compressor of claim 1, wherein an open space of the vane mounting hole, which is not closed by one or more of the upper and lower bearing covers, functions as an oil supply hole for the vane mounting hole.

3. The compressor of claim 1, wherein the lower hearing cover comprises a lower shaft portion that encloses the stationary shaft and a lower cover portion, wherein a bottommost end of the lower shaft portion is immersed in the oil stored in the hermetic container, and wherein the lubrication passage comprises a groove formed in an inner circumferential surface of the lower shaft portion, which is brought into hearing-contact with an outer circumferential surface of the stationary shaft.

4. The compressor of claim 3, wherein the lubrication passage comprises a first oil supply passage formed in a lower portion of the stationary shaft in an axial direction, and a second oil supply passage formed in the eccentric portion to communicate with the first oil supply passage and a top surface of the eccentric portion.

5. The compressor of claim 4, further comprising a refrigerant suction passage that penetrates through the stationary shaft and the eccentric portion and connects to a suction pocket of the compression space, wherein the second oil supply passage makes a detour around the refrigerant suction passage and extends to an upper portion of the eccentric portion.

6. The compressor of claim 4, wherein the lubrication passage comprises upper and lower groove portions formed in top and bottom surfaces of the eccentric portion, respectively, and wherein the upper and lower groove portions function as oil storage grooves to lubricate a thrust surface between the rotary member and the eccentric portion.

7. The compressor of claim 4, wherein the lubrication passage further comprises a first oil storage groove provided in contact portions of the eccentric portion and a lower portion of the stationary shaft, and the lower bearing cover to communicate with the first oil supply passage, and a second oil storage groove provided in contact portions of the eccentric portion and an upper portion of the stationary shaft, and the upper bearing cover to communicate with the second oil supply passage.

8. The compressor of claim 7, wherein the upper bearing cover comprises an upper shaft portion that encloses a portion of the top end of the stationary shaft, and wherein the lubrication passage further comprises a groove provided in an inner circumferential surface of the shaft portion of the upper bearing cover to communicate with the second oil storage groove.

9. The compressor of claim 1, further comprising an oil supply member mounted at a lower portion of the rotary member, that pumps the oil to the lubrication passage when the rotary member is rotated.

10. The compressor of claim 9, wherein the lower bearing cover comprises a lower shaft portion that encloses the stationary shaft, and wherein the oil supply member comprises a hollow shaft portion press-fit into the lower shaft portion, and a propeller fixed to an inside of the hollow shaft portion to lift the oil in a spiral form with the rotation of the lower shaft portion.

* * * * *